US006569523B2

(12) United States Patent
Ikeda et al.

(10) Patent No.: US 6,569,523 B2
(45) Date of Patent: May 27, 2003

(54) CARBON FIBER BUNDLE

(75) Inventors: Katsuhiko Ikeda, Otake (JP); Masakazu Hoshino, Otake (JP); Takayoshi Yamamoto, Otake (JP); Aritaka Shimotashiro, Otake (JP); Toshihiro Makishima, Nagoya (JP); Masashi Okamoto, Otake (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 10/293,324

(22) Filed: Nov. 14, 2002

(65) Prior Publication Data

US 2003/0064221 A1 Apr. 3, 2003

Related U.S. Application Data

(62) Division of application No. 09/885,963, filed on Jun. 22, 2001, now Pat. No. 6,503,624.

(30) Foreign Application Priority Data

Jun. 23, 2000 (JP) ..... 2000-190150
Jul. 3, 2000 (JP) ..... 2000-201535

(51) Int. Cl.[7] ..... D01F 6/00; D01F 9/12

(52) U.S. Cl. ..... 428/357; 428/367; 423/447.1; 423/447.2

(58) Field of Search ..... 428/367, 357, 428/408; 423/447.1, 447.2

(56) References Cited

U.S. PATENT DOCUMENTS 5,030,282 A * 7/1991 Matsuhashi et al. ..... 106/692
5,167,945 A 12/1992 Ogawa et al.
5,227,237 A 7/1993 Saruyama et al.
6,120,894 A 9/2000 Yamamoto et al.
6,245,423 B1 6/2001 Ikeda et al.

FOREIGN PATENT DOCUMENTS

| | | |
|---|---|---|
| DE | 36 10 517 | 10/1986 |
| DE | 690 33 221 | 2/2000 |
| EP | 0 416 789 A2 | 3/1991 |
| FR | 2 579 630 | 10/1986 |
| GB | 2 175 576 | 12/1986 |
| JP | 44-21808 | 9/1969 |
| JP | 58156028 | 9/1983 |
| JP | 58169518 | 10/1983 |
| JP | 58214526 | 12/1983 |
| JP | 61-225373 | 10/1986 |
| JP | 3-185121 | 8/1991 |
| JP | 2000-96354 | 4/2000 |
| JP | 2000-144521 | 5/2000 |
| KR | 0156870 | 7/1998 |

* cited by examiner

*Primary Examiner*—N. Edwards
(74) *Attorney, Agent, or Firm*—Oblon, Spivak, McClelland, Maier & Neustadt, P.C.

(57) ABSTRACT

The carbon fiber precursor fiber bundle of the present invention is an acrylonitrile-based fiber bundle wherein the ratio of the length and width of the fiber cross section of a monofilament (length/width) is 1.05 to 1.6, and the amount of Si measured by ICP (Inductively Coupled Plasma) atomic emission spectrometry is in the range of 500 to 4,000 ppm. This type of carbon fiber precursor fiber bundle has a high compactness, and the carbonizing processing ability is good. Furthermore, for the carbon fiber bundle which is to obtained hereafter, the resin impregnating ability and tow spreading ability are good, the strength increases, and it has bulkiness. Furthermore, the carbon fiber precursor fiber bundle of the present invention is an acrylonitrile-based fiber bundle wherein the liquid content ratio HW is 40 wt. % or more and less than 60 wt. %. The carbon fiber bundle obtained from this type of carbon fiber precursor fiber bundle improves the bulkiness and is superior in resin impregnating ability, tow spreading ability, and covering ability when made into cloth.

18 Claims, 2 Drawing Sheets

CARBON FIBER BUNDLE

BACKGROUND OF THE INVENTION

1. Field of the Invention

The present invention relates to a carbon fiber precursor fiber bundle comprising monofilaments of an acrylonitrile-based polymer that is applicable in manufacturing a carbon fiber bundle for use as reinforcing material in a fiber reinforced composite material.

This application is based on Japanese Patent Application No. 2000-190150 and Japanese Patent Application No. 2000-201535, the contents of which are incorporated herein by reference.

2. Description of Related Art

Carbon fiber, glass fiber, aramid fiber, and the like, are used in a fiber reinforced composite material. Among the aforementioned, carbon fiber is superior in relative strength, relative modulus of elasticity, thermal resistance, chemical resistance, and the like, and is used as reinforcing material in a fiber reinforced composite material for use in sporting equipment such as in golf shafts and fishing rods, as well as for general industrial purposes such as in aircraft, and the like. Such fiber reinforced composite material is manufactured, for example, according to the following method.

Initially, in the baking process (oxidizing process), a carbon fiber precursor fiber bundle comprising monofilaments of acrylonitrile-based polymers undergoes baking at 200 to 300° C. in an oxidizing gas, such as air, to yield a flame-resistant fiber bundle. Subsequently, in the carbonizing process, the flame-resistant fiber bundle is carbonized at 300 to 2000° C. under an inert atmosphere to yield a carbon fiber bundle. This carbon fiber bundle is processed, as necessary, into woven cloth, and the like, which is then impregnated by a synthetic resin and formed into a predetermined shape, to obtain a fiber reinforced composite material.

A precursor fiber bundle used in manufacturing a carbon fiber bundle is required to possess a high compactness such that, during the baking process, the monofilaments comprising a fiber bundle do not unravel and get entangled with neighboring fiber bundles, or alternatively stick to the roller. However, the resultant carbon fiber bundle obtained from a precursor fiber bundle having a high compactness possesses a problem in that it is very difficult to impregnate with resin due to its high compactness.

In addition, a carbon fiber fabric obtained by weaving carbon fiber bundles must be a fabric with as few apertures as possible, so as to avoid creating voids in the resin, at the time of impregnation by the resin. As a result, a tow spreading process is performed either during or after weaving. However, a carbon fiber bundle obtained from a precursor fiber bundle with high compactness possesses a problem in that tow spreading is extremely difficult due to its high compactness.

As a precursor fiber bundle that has a high compactness, and which can provide a carbon fiber bundle having a tow spreading ability, Japanese Patent Application, First Publication Laid Open No. 2000-144521 discloses an acrylonitrile-based fiber bundle comprising acrylonitrile-based polymers containing at least 95 wt. % of acrylonitrile, in which the total denier is at least 30,000, with 2 to 15 essentially continuous wrinkles, each of which is 0.5 to 1.0 μm in height and extends in the longitudinal direction on the surface of the fiber bundle, wherein the absorption volume of iodine per fiber weight of the fiber bundle is 0.5 to 1.5 wt. %.

This precursor fiber bundle is obtained by means of extruding a spinning solution which is a solution of an organic solvent and an acrylonitrile-based polymer to a first coagulation bath formed from an aqueous solution of an organic solvent comprising an organic solvent concentration of 50 to 70 wt. % and a temperature of 30 to 50° C. to form solid fibers. Solid fibers are then taken-up at a take-up speed no greater than 0.8 times a extrusion linear speed of the spinning solution from the first coagulation bath. Subsequently, solid fibers are placed in a second coagulation bath formed from an aqueous solution of an organic solvent comprising an organic solvent concentration of 50 to 70 wt. % and a temperature of 30 to 50° C., and drawn by 1.1 to 3.0 fold, thereby yielding the precursor fiber bundle.

However, the compactness of this precursor fiber bundle and the tow spreading ability of the carbon fiber bundle obtained from this precursor fiber bundle are inadequate. In addition, the carbon fiber woven material requires a uniform texture with few apertures, and thus a carbon fiber bundle having a high bulkiness is required.

In this manner, a carbon fiber precursor fiber bundle having a high compactness and excellent carbonizing processing ability, which is able to provide a carbon fiber bundle possessing an excellent resin impregnating ability, an excellent tow spreading ability, a high strength and high bulkiness, is required.

In addition, with respect to the cloth of carbon fiber, since a favorable external appearance and handling is also in great demand, in addition to the above-mentioned functions, it is necessary to also provide "covering ability" to the carbon fiber. In order to simultaneously provide the aforementioned resin impregnating ability, tow spreading ability, and covering ability at the time of forming a cloth, it is necessary to impart a high bulkiness to the carbon fiber bundle. Hence, in order to further improve the resin impregnating ability, tow spreading ability, and covering ability, it is necessary to further improve the bulkiness of the carbon fiber bundle.

Accordingly, it is a first object of the present invention to provide a carbon fiber precursor fiber bundle having a high compactness and excellent carbonizing processing ability, which is able to provide a carbon fiber bundle possessing an excellent resin impregnating ability and tow spreading ability, in addition to a high strength and high bulkiness.

In addition, it is a second object of the present invention to provide a carbon fiber precursor fiber bundle which is able to provide a carbon fiber bundle possessing an improved bulkiness, in addition to a superior resin impregnating ability, tow spreading ability, and covering ability at the time of forming a cloth.

SUMMARY OF THE INVENTION

The carbon fiber precursor fiber bundle according to a first embodiment of the present invention is characterized in comprising a plurality of monofilaments of acrylonitrile-based polymer, wherein the ratio of the length and width of the fiber cross section of the monofilament (length/width) is 1.05 to 1.6, and the amount of Si measured by ICP atomic emission spectrometry is in the range of 500 to 4,000 ppm.

The aforementioned carbon fiber precursor fiber bundle has a high compactness and excellent carbonizing processing ability. In addition, the carbon fiber bundle obtained therefrom possesses an excellent resin impregnating ability and tow spreading ability, in addition to a high strength and high bulkiness.

In addition, the monofilament strength within this carbon fiber precursor fiber bundle is preferably at least 5.0 cN/dtex. As a result, the generation of fluff secondary to cutting of the monofilaments during the baking process is reduced, which in turn leads to further improvement of the carbonizing processing ability.

In addition, the center line average height (Ra) of the monofilament surface of the carbon fiber precursor fiber bundle is preferably 0.01 to 0.1 μm. In this manner, it is possible to further improve the compactness and carbonizing processing ability of the carbon fiber precursor fiber bundle, and also further improve the resin impregnating ability, tow spreading ability, and strength of the carbon fiber bundle obtained therefrom.

In addition, the maximum height (Ry) of the monofilament surface of the carbon fiber precursor fiber bundle is preferably 0.1 to 0.5 μm. In this manner, it is possible to further improve the compactness and carbonizing processing ability of the carbon fiber precursor fiber bundle, and also further improve the resin impregnating ability, tow spreading ability, and strength of the carbon fiber bundle obtained therefrom.

In addition, this carbon fiber precursor fiber bundle is further characterized in comprising a plurality of wrinkles extending in the longitudinal direction on the surface of the monofilament, wherein the interval (S) between neighboring local peaks is within the range of 0.2 to 1.0 μm. In this manner, it is possible to further improve the compactness and carbonizing processing ability of the carbon fiber precursor fiber bundle, and also further improve the resin impregnating ability, tow spreading ability, and strength of the carbon fiber bundle obtained therefrom.

In addition, the water content of this carbon fiber precursor fiber bundle is preferably no greater than 15 wt. %. In this manner, the monofilaments of the fiber bundle are easily confounded, thereby further improving the carbonizing processing ability.

In addition, the number of monofilaments comprising this carbon fiber precursor fiber bundle is preferably no greater than 12000. In this manner, it is possible to increase the spinning rate of the carbon fiber precursor fiber bundle. In addition, it is also possible to impart uniform confounding, and as a result, improve the processing ability during the baking process.

In addition, the confounding degree of the carbon fiber precursor fiber bundle is preferably within the range of 5/m to 20/m. In this manner, the carbonizing processing ability of the carbon fiber precursor fiber bundle is further improved, which in turn leads to further improvement of the resin impregnating ability and tow spreading ability of the carbon fiber bundle obtained therefrom.

The carbon fiber precursor fiber bundle according to a second embodiment of the present invention is characterized in comprising a plurality of monofilaments of acrylonitrile-based polymer, wherein the liquid content ratio HW, calculated according to the following method, is at least 40 wt. % and no greater than 60 wt. %.

(Liquid Content Ratio Calculation Method)

The liquid content ratio HW is calculated using the following equation from the absolute dry weight W0 of the fiber bundle following removal of an oiling agent and drying to a absolute dry state, and the fiber bundle weight WT after soaking this fiber bundle in distilled water at 20° C. under zero tension for one hour and then performing compression dehydration under a pressure of 200 kPa.

$$HW(\text{wt. }\%)=(WT-W0)/W0\times 100$$

The carbon fiber bundle obtained from this carbon fiber precursor fiber bundle has an improved bulkiness, and a superior resin impregnating ability, tow spreading ability, and covering ability at the time of forming a cloth.

In addition, the center line average height (Ra) of the monofilament surface of this carbon fiber precursor fiber bundle is preferably at least 0.01 μm. In this manner, the bulkiness of the carbon fiber bundle is further improved, which in turn leads to further improvement of the resin impregnating ability, tow spreading ability, and covering ability at the time of forming a cloth.

In addition, the maximum height (Ry) of the monofilament surface of this carbon fiber precursor fiber bundle is preferably at least 0.1 μm. In this manner, the bulkiness of the carbon fiber bundle is further improved, which in turn leads to further improvement of the resin impregnating ability, tow spreading ability, and covering ability at the time of forming a cloth.

In addition, this carbon fiber precursor fiber bundle is further characterized in comprising a plurality of wrinkles extending in the longitudinal direction on the surface of the monofilament, wherein the interval (S) between neighboring local peaks is preferably at least 0.2 μm, and no greater than 1.0 μm. In this manner, it is possible to maintain the excellent carbonizing processing ability of the carbon fiber precursor fiber bundle, and further improve the resin impregnating ability, tow spreading ability of the carbon fiber bundle obtained therefrom, and covering ability at the time of forming a cloth.

In addition, the water content of this carbon fiber precursor fiber bundle is preferably no greater than 15 wt. %. In this manner, the monofilaments of the carbon fiber precursor fiber bundle are easily confounded, thereby further improving the carbonizing processing ability thereof.

In addition, the number of monofilaments comprising this carbon fiber precursor fiber bundle is preferably no greater than 12000. In this manner, it is possible to increase the spinning rate of the carbon fiber precursor fiber bundle. In addition, it is also possible to impart uniform confounding, and as a result, improve the processing ability during the baking process.

In addition, the confounding degree of the carbon fiber precursor fiber bundle is preferably within the range of 5/m to 20/m. In this manner, it is possible to maintain the excellent carbonizing processing ability of the carbon fiber precursor fiber bundle, and further improve the resin impregnating ability and tow spreading ability of the carbon fiber bundle obtained therefrom, and covering ability at the time of forming a cloth.

The carbon fiber precursor fiber bundle according to a third embodiment of the present invention is characterized in comprising a plurality of monofilaments of acrylonitrile-based polymer, wherein the ratio of the length and width of the fiber cross section of the monofilament (length/width) is 1.05 to 1.6; the amount of Si measured by ICP atomic emission spectrometry is in the range of 500 to 4,000 ppm; and the liquid content ratio HW, calculated according to the aforementioned method, is at least 40 wt. % and less than 60 wt. %.

The carbon fiber precursor fiber bundle formed according to the aforementioned displays a high compactness and excellent carbonizing processing ability, and is able to provide a carbon fiber bundle possessing an excellent resin impregnating ability and tow spreading ability, in addition to a high strength and high bulkiness. In addition, the carbon fiber bundle obtained from the aforementioned carbon fiber precursor fiber bundle possesses an improved bulkiness, in addition to a superior resin impregnating ability, tow spreading ability, and covering ability at the time of forming a cloth.

In addition, the method for manufacturing a carbon fiber precursor fiber bundle according to the present invention comprises the steps of:

extruding a spinning solution which is a solution of an organic solvent and an acrylonitrile-based polymer containing at least 95 wt. % of the acrylonitrile unit into a first coagulation bath formed from an aqueous solution of an organic solvent comprising the organic solvent concentration of 45 to 68 wt. % and a temperature of 30 to 50° C. to form solid fibers;

taking-up solid fibers at a take-up speed no greater than 0.8 times an extrusion linear speed of the spinning solution from the first coagulation bath;

drawing solid fibers by 1.1~3.0 fold in a second coagulation bath formed from an aqueous solution of an organic solvent comprising the organic solvent concentration of 45 to 68 wt. % and a temperature of 30 to 50° C. to form drawn fibers; and steam-drawing drawn fibers by 2.0~5.0 fold after drying drawn fibers.

According to this method for manufacturing a carbon fiber precursor fiber bundle, a carbon fiber precursor fiber bundle possessing the aforementioned superior properties may be easily manufactured.

DESCRIPTION OF THE PREFERRED EMBODIMENTS

Figure 1:
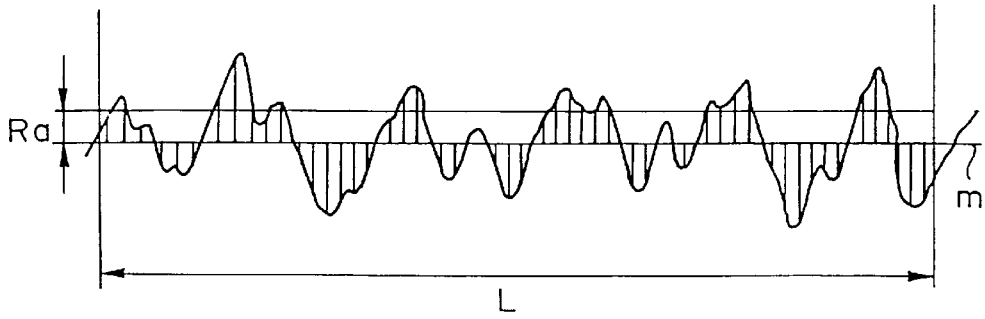
FIG. 1 is a cross sectional diagram showing the surface of a monofilament of a carbon fiber precursor fiber bundle for the purpose of explaining the center line average height (Ra).

In the following, the present invention will be further described by means of the preferred embodiments.

(First Embodiment of a Carbon Fiber Precursor Fiber Bundle)

The carbon fiber precursor fiber bundle according to the first embodiment of the present invention is a tow bundling a plurality of monofilaments of acrylonitrile-based polymer.

As the acrylonitrile-based polymer, a polymer containing at least 95 wt. % of the acrylonitrile unit is preferred from the standpoint of the strength achieved in the carbon fiber bundle formed by means of baking the aforementioned carbon fiber precursor fiber bundle. The acrylonitrile-based polymer may be formed by means of polymerizing acrylonitrile and a monomer that is able to be copolymerized therewith, as necessary, via redox polymerization in an aqueous solution, suspension polymerization in a non-uniform system, emulsion polymerization using a dispersing agent, or the like.

The aforementioned monomer to be copolymerized with acrylonitrile may include, for example, (meth)acrylate esters such as methyl (meth)acrylate, ethyl (meth)acrylate, propyl (meth)acrylate, butyl (meth)acrylate, hexyl (meth)acrylate, and the like; halogenated vinyls such as vinyl chloride, vinyl bromide, vinylidene chloride, and the like; acids such as methacrylic acid, itaconic acid, crotonic acid, salts thereof, and the like; maleimide, phenylmaleimide, methacrylamide, styrene, α-methylstyrene, vinyl acetate; polymerizable unsaturated monomer containing a sulfonic group such as styrene sulfonic acid soda, allylsulfonic acid soda, β-styrene sufonic acid soda, methallyl sufonic acid soda, and the like; polymerizable unsaturated monomer containing a pyridine group such as 2-vinylpyridine, 2-methyl-5-vinylpyridine, and the like.

The ratio (length/width) of the length and width of the fiber cross section of a monofilament of the acrylonitrile-based polymer according to the present invention is 1.05 to 1.6, preferably 1.1 to 1.3, and more preferably 1.15 to 1.25. As long as the length/width ratio is within the aforementioned range, it is possible to simultaneously satisfy the carbonizing processing ability of the precursor fiber bundle, in addition to satisfying the resin impregnating ability and tow spreading ability of the carbon fiber bundle obtained therefrom. When the length/width ratio is less than 1.05, the gaps between the monofilaments are reduced, which in turn lead to a degradation in the resin impregnating ability and tow spreading ability of the resultant carbon fiber bundle. In addition, the bulkiness becomes insufficient. When the length/width ratio is greater than 1.6, the compactness of the fiber bundle is reduced, which in turn results in degradation of the carbonizing processing ability. In addition, the strand strength also is drastically reduced.

Here, the ratio (length/width) of the length and width of the fiber cross section of a monofilament is determined in the following manner.

After passing a fiber bundle of an acrylonitrile-based polymer, for use in measuring, through a tube manufactured from poly(vinyl chloride) having an inner diameter of 1 mm, the aforementioned is sectionally cut into round slices prepare a sample. Subsequently, the aforementioned sample is fixed on a sample holder of a SEM in a manner such that the fiber cross section of the acrylonitrile-based polymer is facing upward. Furthermore, after spattering Au at an approximate thickness of 10 nm, the fiber cross section is observed using a scanning electron microscope (XL20 manufactured by Phillips) under the conditions of an accelerating voltage of 7.00 kV, and operating distance of 31 mm. The length and width of the fiber cross section of the monofilament are then measured, and the length/width ratio is determined by means of dividing the length by the width.

The amount of Si of the carbon fiber precursor fiber bundle according to the present invention is within the range of 500 to 4000 ppm, and preferably within the range of 1000~3000 ppm. As long as the amount of Si is within the aforementioned range, it is possible to simultaneously satisfy the carbonizing processing ability of the precursor fiber bundle, in addition to satisfying the resin impregnating ability and tow spreading ability of the carbon fiber bundle obtained therefrom. When the amount of Si is less than 500 ppm, the compactness of the fiber bundle deteriorates, which in turn leads to degradation of the carbonizing processing ability. In addition, the strand strength of the resultant carbon fiber bundle also deteriorates. When the amount of Si exceeds 4000 ppm, the silica is widely scattered at the time of baking the precursor fiber bundle, which leads to a worsening of the carbonizing stability. In addition, the resultant carbon fiber bundle becomes difficult to unravel, resulting in worsening of the resin impregnating ability and tow spreading ability thereof.

The amount of Si originates from the silicon-based oiling agent used at the time of manufacturing the carbon fiber precursor fiber bundle. Here, the amount of Si can be measured by means of using ICP atomic emission spectrometry.

The monofilament strength of the acrylonitrile-based polymer according to the present invention is preferably at least 5.0 cN/dtex, more preferably at least 6.5 cN/dtex, and most preferably 7.0 cN/dtex. When the monofilament strength is less than 5.0 cN/dtex, a large amount of fluff is generated by means of cutting single threads during the carbonizing process, which results in a degradation of the carbonizing processing ability.

Here, the monofilament strength of the acrylonitrile-based polymer is determined by means of installing the monofilament, which has been placed onto a mount, into the chuck of the load cell, and then measuring the tensile strength thereof via a tension test at a rate of 20.0 mm per minute using a monofilament automatic tensile strength testing machine (UTM II-20 manufactured by K.K Orientech).

The carbon fiber precursor fiber bundle of the present invention preferably has wrinkles extending in the longitudinal direction of the fiber bundle on the surface of the monofilament. The presence of these wrinkles imparts an excellent compactness to the carbon fiber precursor fiber bundle of the present invention, and at the same time, the resultant carbon fiber bundle displays an excellent resin impregnating ability and tow spreading ability.

The depth of the aforementioned wrinkle is set according to the center line average height (Ra), maximum height (Ry) and interval (S) of the local peaks.

The center line average height (Ra) of the surface of the monofilament of the carbon fiber precursor fiber bundle according to the present invention is preferably 0.01 to 0.1 μm, more preferably 0.02 to 0.07 μm, and most preferably 0.03 to 0.06 μm. A center line average height (Ra) of less than 0.01 μm results in degradation of the resin impregnating ability and tow spreading ability of the resultant carbon fiber bundle, and leads to an insufficient bulkiness. On the other hand, a center line average height (Ra) of greater than 0.1 μm results in an increase in the surface area of the fiber bundle, which in turn leads to easy generation of static electricity. Consequently, the compactness of the fiber bundle decreases. In addition, the strand strength of the resultant carbon fiber bundle is reduced.

Here, as shown in FIG. 1, the center line average height (Ra) is determined by means of sampling a standard length L in the direction of the center line m from the roughness curve; calculating the absolute value of the deviation from the center line m to the measuring curve of this sample; and then taking the average value therefrom. The center line average height (Ra) is measured by means of using a laser microscope.

The maximum height (Ry) of the monofilament surface of the carbon fiber precursor fiber bundle according to the present invention is preferably 0.1 to 0.5 μm, more preferably 0.15 to 0.4 μm, and most preferably 0.2 to 0.35 μm. A maximum height (Ry) of less than 0.1 μm results in degradation of the resin impregnating ability and tow spreading ability of the resultant carbon fiber bundle, and leads to an insufficient bulkiness. On the other hand, a maximum height (Ry) of greater than 0.5 μm results in an increase in the surface area of the fiber bundle, which in turn leads to easy generation of static electricity. Consequently, the compactness of the fiber bundle decreases. In addition, the strand strength of the resultant carbon fiber bundle is reduced.

Figure 2:
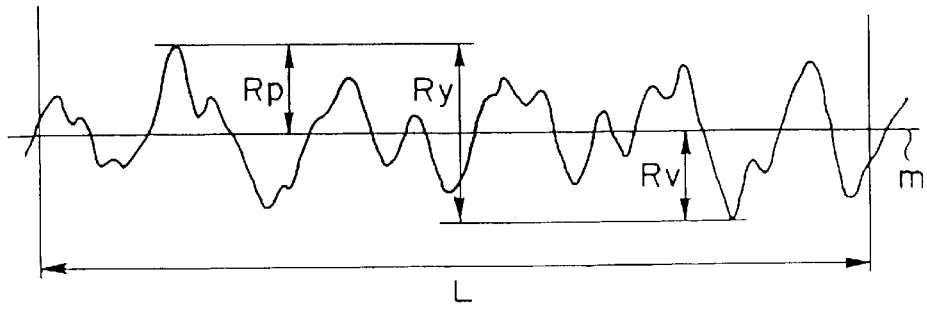
FIG. 2 is a cross sectional diagram showing the surface of a monofilament of a carbon fiber precursor fiber bundle for the purpose of explaining the maximum height (Ry).

Here, as shown in FIG. 2, the maximum height (Ry) is determined by means of sampling a standard length L in the direction of the center line m from the roughness curve; calculating the sum of a Rp, which is interval between the peak line and the center line m of this sample, and a Rv, which is interval between the valley line and the center line m of this sample. The maximum height (Ry) is measured by means of using a laser microscope.

In addition, the interval (S) between neighboring local peaks which serves as a parameter specifying the interval of these wrinkle is preferably 0.2 to 1.0 μm, more preferably 0.3 to 0.8 μm, and most preferably 0.4 to 0.7 μm. An interval (S) between neighboring local peaks of less than 0.2 μm results in degradation of the resin impregnating ability and tow spreading ability of the resultant carbon fiber bundle, and leads to an insufficient bulkiness. On the other hand, an interval (S) between neighboring local peaks of greater than 1.0 μm results in an increase in the surface area of the fiber bundle, which in turn leads to easy generation of static electricity. Consequently, the compactness of the fiber bundle decreases. In addition, the strand strength of the resultant carbon fiber bundle is reduced.

Figure 3:
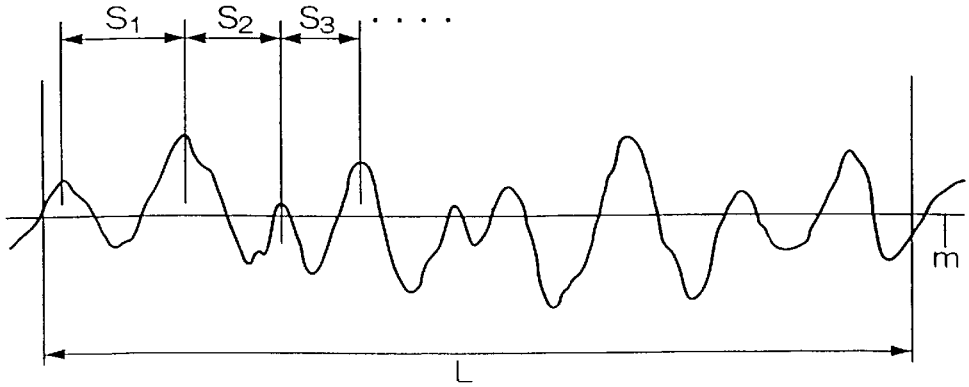
FIG. 3 is a cross sectional diagram showing the surface of a monofilament of a carbon fiber precursor fiber bundle for the purpose of explaining the interval (S) between the local peaks.

Here, as shown in FIG. 3, the interval (S) between neighboring local peaks is determined by means of sampling a standard length L in the direction of the center line m from the roughness curve, and then taking the average value S of the intervals $S_1$, $S_2$, $S_3$, . . . between the neighboring peaks of this sample. The interval (S) between neighboring local peaks is measured by means of using a laser microscope.

In addition, the water content of the carbon fiber precursor fiber bundle according to the present invention is preferably no greater than 15 wt. %, more preferably no greater than 10 wt. %, and most preferably within the range of 3 to 5 wt. %. A water content exceeding 15 wt. % leads to difficulty in confounding the monofilaments at the time of blasting air into the fiber bundle to perform the confounding process. This subsequently results in easy unraveling of the fiber bundle and worsening of the carbonizing processing ability.

Here, the water content is a numeral calculated using the following equation from the weight w of the fiber bundle in a wet state, and the weight $w_0$ after drying the fiber bundle at 105° C. for 2 hours using a hot-air dryer.

$$\text{Water content(wt. \%)}=(w-w_0)\times 100/w_0$$

In addition, the number of monofilaments comprising the carbon fiber precursor fiber bundle according to the present invention is preferably no greater than 12000, more preferably no greater than 6000, and most preferably no greater than 3000. When the number of monofilaments exceeds 12000, the tow handling and tow volume increase, which in turn increase the drying load such that increasing the spinning speed is no longer possible. In addition, it also becomes difficult to impart uniform confounding, which results in worsening of the carbonizing processing ability.

In addition, the confounding degree of the carbon fiber precursor fiber bundle according to the present invention is preferably within the range of 5/m to 20/m, and more preferably within the range of 10/m to 14/m. When the confounding degree is less than 5/m, unraveling of the fiber bundle occurs easily, which in turn leads to worsening of the carbonizing processing ability. A confounding degree exceeding 20/m, on the other hand, leads to degradation of the resin impregnating ability and tow spreading ability of the resultant carbon fiber bundle.

Here, the confounding degree of the carbon fiber precursor fiber bundle is a parameter indicating the number of times a single monofilament within the fiber bundle crosses a neighboring monofilament over the interval of 1 meter. This confounding degree is measured by means of a hook drop method.

(Second Embodiment of a Carbon Fiber Precursor Fiber Bundle)

The carbon fiber precursor fiber bundle according to the second embodiment of the present invention is a tow bundling a plurality of monofilaments of acrylonitrile-based polymer. As the acrylonitrile-based polymer, the same compounds as those used in the carbon fiber precursor fiber bundle of the first embodiment may be used.

The liquid content ratio of the carbon fiber precursor fiber bundle according to the present invention is at least 40 wt. % and less than 60 wt. %, preferably at least 42 wt. % and less than 55 wt. %, and more preferably at least 44 wt. % and less than 53 wt. %. As long as the liquid content ratio lies within the aforementioned range, it is possible to both improve the bulkiness of the resultant carbon fiber bundle, and satisfy the carbonizing processing ability of the precursor fiber bundle. A liquid content ratio of less than 40 wt. % results in an insufficient bulkiness of the resultant carbon fiber bundle, which in turn leads to deterioration in the resin impregnating ability, tow spreading ability, and covering ability at the time of forming a cloth. A liquid content ratio of 60 wt. % or more leads to a reduction in the compactness of the fiber bundle and worsening of the carbonizing processing ability.

Here, the liquid content ratio of the carbon fiber precursor fiber bundle is determined in the following manner.

Initially, the oiling agent adhering to the carbon fiber precursor fiber bundle is adequately washed and removed using either boiling water at 100° C. or methylethyl ketone (MEK) at room temperature. Subsequently, the carbon fiber precursor fiber bundle is dried using a dryer at 105° C. for 2 hours to yield a fiber bundle in an absolute dry state. The absolute dry weight W0 of the fiber bundle at this time is then measured.

Here, the oiling agent refers to the oiling agent used at the time of manufacturing the carbon fiber precursor fiber bundle. Examples of this oiling agent may include silicon-based oiling agents, aromatic ester-based oiling agents, polyether-based oiling agents, and the like.

Subsequently, this fiber bundle is soaked in distilled water at 20° C. under zero tension for one hour to incorporate water into the fiber bundle. The fiber bundle in this water-containing state then undergoes compression dehydration using a nip roller, under a pressure of 200 kPa at a winding speed of 10 m/min. The weight WT of the fiber bundle after compression dehydration is then measured.

The liquid content ratio HW of the carbon fiber precursor fiber bundle is calculated using the following equation from the absolute dry weight W0 of the fiber bundle and the fiber bundle weight WT after undergoing compression dehydration.

$$HW(\text{wt. }\%)=(WT-W0)/W0\times 100$$

The carbon fiber precursor fiber bundle of the present invention preferably comprises a plurality of wrinkles extending in the longitudinal direction of the fiber bundle on the monofilament surface. By means of providing such wrinkles, the carbon fiber bundle obtained from the carbon fiber precursor fiber bundle of the present invention is imparted with an excellent bulkiness.

The depth of these wrinkles is determined by means of the center line average height (Ra) and the maximum height (Ry) as described in the following.

The center line average height (Ra) of the monofilament surface of the carbon fiber precursor fiber bundle according to the present invention is preferably at least 0.01 μm, more preferably 0.02 to 0.5 μm, and most preferably 0.03 to 0.1 μm. A center line average height (Ra) of less than 0.01 μm results in an insufficient bulkiness of the resultant carbon fiber bundle, which in turn leads to deterioration in the resin impregnating ability, tow spreading ability, and covering ability at the time of forming a cloth. On the other hand, an excessively large center line average height (Ra) results in an increase in the surface area of the precursor fiber bundle, which in turn leads to easy generation of static electricity. Consequently, the compactness of the precursor fiber bundle decreases, such that the precursor fiber bundle tends to unravel easily during the baking process, which in turn leads to worsening of the carbonizing processing ability. In addition, there is also a tendency for degradation of the strand strength of the resultant carbon fiber bundle.

The maximum height (Ry) of the monofilament surface of the carbon fiber precursor fiber bundle according to the present invention is preferably at least 0.1 μm, more preferably 0.15 to 0.4 μm, and most preferably 0.2 to 0.35 μm. A maximum height (Ry) of less than 0.1 μm results in an insufficient bulkiness of the resultant carbon fiber bundle, which in turn leads to deterioration in the resin impregnating ability, tow spreading ability, and covering ability at the time of forming a cloth. On the other hand, an excessively large maximum height (Ry) results in an increase in the surface area of the precursor fiber bundle, which in turn leads to easy generation of static electricity. Consequently, the compactness of the precursor fiber bundle decreases, such that the precursor fiber bundle tends to unravel easily during the baking process, which in turn leads to worsening of the carbonizing processing ability. In addition, there is also a tendency for degradation of the strand strength of the resultant carbon fiber bundle.

In addition, the interval (S) between neighboring local peaks which serves as a parameter specifying the interval of these wrinkles is preferably 0.2 to 1.0 μm, more preferably 0.3 to 0.8 μm, and most preferably 0.4 to 0.7 μm. An interval (S) between neighboring local peaks of less than 0.2 μm results in an insufficient bulkiness of the resultant carbon fiber bundle, which in turn leads to deterioration in the resin impregnating ability, tow spreading ability, and covering ability at the time of forming a cloth. On the other hand, an interval (S) between neighboring local peaks of greater than 1.0 μm results in an increase in the surface area of the precursor fiber bundle, which in turn leads to easy generation of static electricity. Consequently, the compactness of the precursor fiber bundle decreases, such that the precursor fiber bundle tends to unravel easily during the baking process, which in turn leads to worsening of the carbonizing processing ability. In addition, there is also a tendency for degradation of the strand strength of the resultant carbon fiber bundle.

In addition, the water content of the carbon fiber precursor fiber bundle according to the present invention is preferably no greater than 15 wt. %, more preferably no greater than 10 wt. %, and most preferably within the range of 3 to 5 wt. %. A water content exceeding 15 wt. % leads to difficulty in confounding the monofilaments at the time of blasting air into the precursor fiber bundle to perform the confounding process. This subsequently results in easy unraveling of the fiber bundle and worsening of the carbonizing processing ability.

In addition, the number of monofilaments comprising the carbon fiber precursor fiber bundle according to the present invention is preferably no greater than 12000, more preferably no greater than 6000, and most preferably no greater than 3000. When the number of monofilaments exceeds 12000, the tow handling and tow volume increase, which in turn increase the drying load such that it is not possible to increase the spinning speed. In addition, it also becomes difficult to impart a uniform confounding, which results in worsening of the carbonizing processing ability.

In addition, the confounding degree of the carbon fiber precursor fiber bundle according to the present invention is preferably within the range of 5/m to 20/m, and more preferably within the range of 10/m to 14/m. When the confounding degree is less than 5/m, unraveling of the fiber bundle occurs easily, which in turn leads to worsening of the carbonizing processing ability. A confounding degree exceeding 20/m, on the other hand, results in an insufficient bulkiness of the resultant carbon fiber bundle, which in turn leads to deterioration in the resin impregnating ability, tow spreading ability, and covering ability at the time of forming a cloth.

(Third Embodiment of a Carbon Fiber Precursor Fiber Bundle)

The carbon fiber precursor fiber bundle according to the third embodiment of the present invention is characterized in comprising a plurality of monofilaments of acrylonitrile-based polymer, wherein the ratio of the length and width of the fiber cross section of the monofilament (length/width) is 1.05 to 1.6; the amount of Si measured by ICP atomic emission spectrometry is in the range of 500 to 4,000 ppm; and the liquid content ratio HW, calculated according to the aforementioned method, is at least 40 wt. % and less than 60 wt. %. The carbon fiber precursor fiber bundle according to the third embodiment combines both the properties of the carbon fiber precursor fiber bundles of the first and second embodiments.

(Method for Manufacturing A Carbon Fiber Precursor Fiber Bundle)

In the following, the method for manufacturing a carbon fiber precursor fiber bundle according to the present invention will be described.

A carbon fiber precursor fiber bundle according to the present invention may be manufactured in the following manner.

Initially, a spinning solution which is a solution of an organic solvent and an acrylonitrile-based polymer is extruded through a spinneret into a first coagulation bath formed from an aqueous solution of an organic solvent comprising the organic solvent concentration of 45 to 68 wt. % and a temperature of 30 to 50° C. to form solid fibers. Solid fibers are then taken-up at a take-up speed no greater than 0.8 times an extrusion linear speed of the spinning solution from the first coagulation bath.

Subsequently, the aforementioned solid fibers are then drawn by 1.1 to 3.0 fold in a second coagulation bath formed from an aqueous solution of an organic solvent comprising the organic solvent concentration of 45 to 68 wt. % and a temperature of 30 to 500° C.

Thereafter, when necessary, wet-heat drawing by at least three fold is performed with respect to the fiber bundle, which exists in a swollen state after drawing in the second coagulation bath.

After completing the process of adding a silicon-based oiling agent to the fiber bundle, this fiber bundle is dried, and then further drawn by 2.0 to 5.0 fold by means of using a steam-drawing machine.

Adjustment of the water content is then performed with respect to this fiber bundle by means of using a touch roll. Subsequently, air is blasted into the fiber bundle to perform the confounding process, thereby yielding the carbon fiber precursor fiber bundle.

Examples of the organic solvent for an acrylonitrile-based polymer used in the spinning solution include dimethyl acetamide, dimethyl sulfoxide, dimethyl formamide, and the like. Among the aforementioned, dimethyl acetamide is ideally used for its excellent spinning characteristics, and minimal adverse effects on the hydrolysis of the solvent.

Here, preparation of the first and second coagulation baths is prepared easy by means of using the same concentration of organic solvent in the first and second coagulation baths; setting the first and second coagulation baths to the same temperature; or further using the same organic solvent in the spinning solution, first coagulation bath and second coagulation bath. Moreover, there is also considerable merit in being able to recycle the organic solvent.

By means of using an spinning solution formed from a dimethyl acetamide solution of an acrylonitrile-based polymer, a first coagulation bath formed from a dimethyl acetamide aqueous solution, and a second coagulation bath formed from a dimethyl acetamide aqueous solution at the same temperature and comprising the same composition as the first coagulation bath, it is possible to easily manufacture a monofilament having a fiber cross section length/width ratio of 1.05 to 1.6.

In addition, by means of lowering the concentration of the organic solvent in the first coagulation bath and second coagulation bath, it is possible to obtain a monofilament having a large fiber cross section length/width ratio. On the other hand, by means of increasing the concentration of the organic solvent in the first coagulation bath and second coagulation bath, it is possible to obtain a monofilament having a fiber cross section length/width ratio close to 1.0. In other words, when the concentration of the organic solvent in the first coagulation bath and second coagulation bath falls outside of the range of 45 to 68 wt. %, it becomes difficult to obtain a monofilament having a fiber cross section length/width ratio of 1.05 to 1.60.

As the spinneret for extruding the spinning solution, it is possible to use a spinneret having a nozzle opening comprising a diameter of 15 to 100 $\mu$m, in other words, a diameter used at the time of manufacturing a monofilament comprising an acrylonitrile-based polymer of approximately 1.0 denier (1.1 dTex), which serves as the standard size of a monofilament comprising an acrylonitrile-based polymer.

By means of setting the "take-up speed of solid fibers/extrusion linear speed of the spinning solution from the nozzle" to no greater than 0.8, it is possible to maintain excellent spinning properties.

In this method for manufacturing a carbon fiber precursor fiber bundle, the concentration of the organic solvent contained in solution in the solid fiber taken-up from the first coagulation bath exceeds the concentration of the organic solvent in the aforementioned first coagulation bath. As a result, the solid fiber assumes a half-coagulated state which is coagulating only on its surface, such that this solid fiber displays an excellent drawing ability in the second coagulation bath of the subsequent process.

In addition, it is possible to draw the solid fiber, which is taken-up from the first coagulation bath in a swollen state with the coagulation solution contained therein, in the air. However, by means of employing a means for drawing this solid fiber in the second coagulation bath as described in the aforementioned method, it is possible to further promote the coagulating of the solid fiber. In addition, temperature control of the drawing process is also rendered easy.

With respect to the drawing ratio in the second coagulation bath, when this ratio is less than 1.1, it becomes impossible to obtain a uniformly oriented fiber; on the other hand, when this ratio is greater than 3.0, tears in the monofilament occur easily, which in turn results in degradation of the spinning stability and worsening of the drawing ability in the subsequent wet heat drawing process.

The wet heat drawing that is performed after the drawing process in the second coagulation bath, is for the purpose of further improving the orientation of the fiber. This wet heat drawing is performed on the swollen fiber bundle, in its swollen state after the drawing in the second coagulation bath, either while rinsing with water or in hot water. Among the aforementioned, from the standpoint of high productivity, it is preferable to perform the above-described wet heat drawing in hot water. Furthermore, when the drawing ratio for this wet heat drawing process is less than 3.0, improvement of the fiber orientation becomes insufficient.

In addition, the degree of swelling of the swollen fiber bundle, after wet heat drawing and prior to drying, is preferably no greater than 70 wt. %.

In other words, a fiber having a degree of swelling of the swollen fiber bundle, after wet heat drawing and prior to drying, of no greater than 70 wt. % comprises a uniformly oriented surface layer and fiber interior. By means of decreasing the "take-up speed of solid fibers/extrusion linear speed of the spinning solution from the nozzle" at the time of manufacturing solid fibers in the first coagulation bath, it is possible to uniformly orient the fiber all the way to its interior, after uniformly coagulating the spinning solution to solid fibers in the first coagulation bath and drawing solid fibers in the second coagulation bath. As a result, it is possible to decrease the degree of swelling of the swollen fiber bundle, after wet heat drawing and prior to drying, to a value of no greater than 70 wt. %.

On the other hand, when the "take-up speed of solid fibers/extrusion linear speed of the spinning solution from the nozzle" at the time of manufacturing solid fibers in the first coagulation bath is high, the coagulation and drawing of solid fibers in the aforementioned first coagulation bath occur at the same time. As a result, coagulation of the spinning solution to solid fibers in the first coagulation bath becomes non-uniform. Consequently, even when performing a drawing process on solid fibers in a second coagulation bath, the swollen fiber bundle, after wet heat drawing and prior to drying, assumes a high degree of swelling, such that a fiber that is uniformly oriented all the way to its fiber interior cannot be realized.

The degree of swelling of the swollen fiber bundle prior to drying is a numeral calculated using the following equation from the weight w after removal of the fluid adhering to the fiber bundle in its swollen state using a centrifuge (15 minutes at 3000 rpm), and weight $w_0$ after drying the aforementioned using a hot-air dryer at 105° C. for 2 hours.

$$\text{Degree of swelling(wt. \%)}=(w-w_0)\times 100/w_0$$

With regard to the process of adding oiling agent to the fiber bundle after performing wet heat drawing, it is possible to use a standard silicon-based oiling agent. This silicon-based oiling agent may be used after adjusting the concentration to 1.0 to 2.5 wt. %.

When the drawing ratio using the steam drawing machine is less than 2.0, improvement of the fiber orientation becomes insufficient. On the other hand, when this ratio is greater than 5.0, tears in the monofilament occur easily, which in turn lead to a reduction of the spinning stability.

EXAMPLES

In the following, the present invention will be described using the examples.

The respective measurements in the present examples are performed according to the following methods.

(Cross-sectional Shape)

A sample is prepared by means of passing fibers comprising an acrylonitrile-based polymer to be measured into a poly(vinyl chloride) tube having an inner diameter of 1 mm, and sectionally cutting the aforementioned into round slices. Subsequently, the sample is fixed on a sample holder of SEM with the fiber cross section of the acrylonitrile-based polymer facing upward. Au is further spattered thereon to a thickness of approximately 10 nm, and the fiber cross section is then observed under a scanning electron microscope (XL20 manufactured by Phillips) under the conditions of an accelerating voltage of 7.00 kV and an operating distance of 31 mm. The length and width of the fiber cross section of a monofilament are then measured, and the length is divided by the width to obtain the length/width ratio.

(Amount of Si)

Initially, a sample is placed in an airtight container manufactured from teflon, and sequential heat acidolysis of the sample is performed using sulfuric acid and then nitric acid. After diluting the sample, the sample is then measured for the amount of Si using an IRIS-AP (manufactured by Jarrel Ash) as an ICP atomic emission spectrometer.

(Liquid Content Ratio)

Initially, a oiling agent adhering to a carbon fiber precursor fiber bundle is first removed by means of adequate washing in boiling water at 100° C. The aforementioned is then dried for 2 hours at 105° C. in a dryer to produce a fiber bundle in an absolute dry state. The absolute dry weight W0 of the fiber bundle at this time is measured. Subsequently, the fiber bundle is soaked in distilled water at 20° C. under zero tension for one hour to incorporate water into the fiber bundle. The fiber bundle in this water-containing state then undergoes compression dehydration using a nip roller, under a pressure of 200 kPa at a winding speed of 10 m/min. The weight WT of the fiber bundle after compression dehydration is then measured. The liquid content ratio HW of the carbon fiber precursor fiber bundle is calculated using the following equation from the absolute dry weight W0 of the fiber bundle and the fiber bundle weight WT after undergoing compression dehydration.

$$HW(\text{wt. \%})=(WT-W0)/W0\times 100$$

(Monofilament Strength)

The monofilament strength is determined by means of installing the monofilament, which has been placed onto a mount, into the chuck of a load cell, and then measuring the tensile strength thereof via a tension test at a rate of 20.0 mm per minute using a monofilament automatic tensile strength testing machine (UTM II-20 manufactured by K.K. Orientech).

(Confounding Degree)

A fiber bundle of the carbon fiber precursor fiber bundle in a dry state is first prepared, and then attached to the upside of a dropping apparatus. A weight is attached to the fiber bundle at a point one meter from the top chuck of the apparatus in the downward direction, and the weight is then suspended. Here, the load of the used weight is ⅕ of the denier in grams. A hook is inserted to the fiber bundle at a point 1 cm below the top chuck of the apparatus, such that the fiber bundle is divided into two parts. The hook is then lowered at a speed of 2 cm/s, and the distance L (mm) that the hook dropped to point where it was stopped by means of intertwinement of the aforementioned fiber bundle is determined. The confounding degree is then calculated by means of the following formula. Moreover, the number of times the test was performed was N=50, and the average value thereof was calculated to one decimal place.

$$\text{Confounding degree}=1000/L$$

Here, the hook used is a pin having a diameter of 0.5 mm to 1.0 mm, which has been processed to form a smooth surface.

(Wrinkle Contour)

The fiber bundle of the carbon fiber precursor in a dry state is mounted onto slide glass, and Ra, Ry and S are measured in the perpendicular direction with respect to the fiber axis using a laser microscope VL 2000 manufactured by Lasertec Corporation.

(Water Content)

The water content is calculated using the following equation from the weight w of the fiber bundle of the carbon fiber precursor in a wet state, and the weight $w_0$ after drying the fiber bundle at 105° C. for 2 hours using a hot-air dryer.

$$\text{Water content(wt. \%)}=(w-w_0)\times 100/w_0.$$

In addition, the resultant acrylonitrile-based fiber bundle and carbon fiber bundle are evaluated according to the following methods.

(Resin Impregnating Ability)

Approximately 20 cm of the carbon fiber bundle are first cut off, and approximately 3 cm are then immersed in glycidyl ether and allowed to sit for 15 minutes. After allowing the carbon fiber bundle to sit for an additional 3 minutes following removal from the glycidyl ether, the lower 3.5 cm are cut off and the length and weight of the remaining carbon fiber bundle are measured. The proportional weight of the glycidyl ether suctioned from the areal weight of the carbon fiber bundle is then calculated and used as the index of the resin impregnating ability.

(Tow Spreading Ability)

The tow width at the time of running the carbon fiber bundle over a metal roll at a running speed of 1 m/min under a tension of 0.06 g/monofilament is used as the index of the tow spreading ability.

(Covering Ability (Covering Ratio))

Using the carbon fiber bundle in the warp and woof, a plain weave cloth comprising the areal weight of 200 g/m$^2$ was manufactured. With regard to this cloth, the aperture ratio (proportion of parts in which both warp and woof are absent within a cloth unit area) was determined by means of using an image processing sensor (CV-100 manufactured by Keyence Corporation), and the covering ratio was obtained by means of subtracting the aperture ratio from 100.

(Carbon Fiber Strand Strength)

This was measured based on the JIS R 7601.

Example 1

Acrylonitrile, methylacrylate, and methacrylic acid were copolymerized under the presence of ammonium persulfate-ammonium hydrogen sulfite and iron sulfate by means of aqueous suspension polymerization to yield an acrylonitrile-based polymer comprising an acrylonitrile unit/methyl acrylate unit/methacrylic acid unit=95/4/1 (parts by weight ratio). This acrylonitrile-based polymer was then dissolved in dimethyl acetamide to prepare a spinning solution of 21 wt. %.

This spinning solution was extruded to a first coagulation bath formed from an aqueous solution of dimethyl acetamide comprising a concentration of 60 wt. % and a temperature of 30° C. passed through a spinneret having a hole number of 3000 and a hole diameter of 75 $\mu$m to form solid fibers. Solid fibers were taken-up from the first coagulation bath at a take-up speed of 0.8 times an extrusion linear speed of the spinning solution. Solid fibers were subsequently introduced into a second coagulation bath, formed from an aqueous solution of dimethyl acetamide comprising a concentration of 60 wt. % and a temperature of 30° C., and drawn by 2.0 fold.

Thereafter, this fiber bundle was then simultaneously washed with water and drawn by 4 fold. An amino silicon-based oiling agent pre-adjusted to 1.5 wt. % was then added thereto. This fiber bundle was then dried using a heat roll and further drawn by 2.0 fold by means of using a steam drawing machine. Subsequently, the water content of the fiber bundle was adjusted, using a touch roll, to a water content of 5 wt. % per fiber of the fiber bundle. This fiber bundle was then subjected to a confounding process using air at an air pressure of 405 kPa, and then wound around a winder to yield an acrylonitrile-based fiber bundle with a monofilament size of 1.1 dtex.

The cross-sectional shape, amount of Si, liquid content ratio, monofilament strength, water content, confounding degree, and wrinkle contour of the resultant acrylonitrile-based fiber bundle were then measured. These results are shown in Tables 1 and 2.

Furthermore, the resultant acrylonitrile-based fiber bundle was then processed in air using a hot-air circulating oxidation oven set at 230 to 260° C. for 50 minutes to yield a flame-resistant fiber bundle. This flame-resistant fiber bundle was subsequently processed under a nitrogen atmosphere at a maximum temperature of 780° C. for 1.5 minutes, and then further processed in a high temperature heat-treating oven, under the same atmosphere, at a maximum temperature of 1300° C. for approximately 1.5 minutes. Electrolysis of this fiber bundle was then performed at 0.4 Amin/m in an aqueous solution of ammonium bicarbonate to yield a carbon fiber bundle. The resin impregnating ability, tow spreading ability, covering ability, and strand strength of this carbon fiber bundle were then evaluated. These results are shown in Table 3.

Example 2

An acrylonitrile-based fiber bundle with a monofilament size of 1.1 dtex was obtained in the same manner as in Example 1 with the exception that the dimethyl acetamide concentration of the first and second coagulation baths was changed to 50 wt. %.

The cross-sectional shape, amount of Si, liquid content ratio, monofilament strength, water content, confounding degree, and wrinkle contour of the resultant acrylonitrile-based fiber bundle were then measured. These results are shown in Tables 1 and2.

Furthermore, the resin impregnating ability, tow spreading ability, covering ability, and strand strength of the carbon fiber bundle obtained by baking the aforementioned acrylonitrile-based fiber bundle were then evaluated. These results are shown in Table 3.

Example 3

An acrylonitrile-based fiber bundle with a monofilament size of 1.1 dtex was obtained in the same manner as in Example 1 with the exception that the dimethyl acetamide concentration of the first and second coagulation baths was changed to 65 wt. %.

The cross-sectional shape, amount of Si, liquid content ratio, monofilament strength, water content, confounding degree, and wrinkle contour of the resultant acrylonitrile-based fiber bundle were then measured. These results are shown in Tables 1 and 2.

Furthermore, the resin impregnating ability, tow spreading ability, covering ability, and strand strength of the carbon fiber bundle obtained by baking the aforementioned acrylonitrile-based fiber bundle were then evaluated. These results are shown in Table 3.

Example 4

An acrylonitrile-based fiber bundle with a monofilament size of 1.1 dtex was obtained in the same manner as in Example 1 with the exception that the drawing ratio in the second coagulation bath was changed to 2.5 fold, and the drawing ratio using the aforementioned steam drawing machine was changed to 1.6 fold.

The cross-sectional shape, amount of Si, liquid content ratio, monofilament strength, water content, confounding degree, and wrinkle contour of the resultant acrylonitrile-based fiber bundle were then measured. These results are shown in Tables 1 and 2.

Furthermore, the resin impregnating ability, tow spreading ability, covering ability, and strand strength of the carbon fiber bundle obtained by baking the aforementioned acrylonitrile-based fiber bundle were then evaluated. These results are shown in Table 3.

Example 5

An acrylonitrile-based fiber bundle with a monofilament size of 1.1 dtex was obtained in the same manner as in Example 1 with the exception that the drawing ratio in the second coagulation bath was changed to 1.2 fold.

The cross-sectional shape, amount of Si, liquid content ratio, monofilament strength, water content, confounding degree, and wrinkle contour of the resultant acrylonitrile-based fiber bundle were then measured. These results are shown in Tables 1 and 2.

Furthermore, the resin impregnating ability, tow spreading ability, covering ability, and strand strength of the carbon fiber bundle obtained by baking the aforementioned acrylonitrile-based fiber bundle were then evaluated. These results are shown in Table 3.

Example 6

An acrylonitrile-based fiber bundle with a monofilament size of 1.1 dtex was obtained in the same manner as in Example 1 with the exception that the water content of the fiber bundle was adjusted to 10 wt. % using the aforementioned touch roll.

The cross-sectional shape, amount of Si, liquid content ratio, monofilament strength, water content, confounding degree, and wrinkle contour of the resultant acrylonitrile-based fiber bundle were then measured. These results are shown in Tables 1 and 2.

Furthermore, the resin impregnating ability, tow spreading ability, covering ability, and strand strength of the carbon fiber bundle obtained by baking the aforementioned acrylonitrile-based fiber bundle were then evaluated. These results are shown in Table 3.

Example 7

An acrylonitrile-based fiber bundle with a monofilament size of 1.1 dtex was obtained in the same manner as in Example 1 with the exception that the water content of the fiber bundle was adjusted to 3 wt. % using the aforementioned touch roll.

The cross-sectional shape, amount of Si, liquid content ratio, monofilament strength, water content, confounding degree, and wrinkle contour of the resultant acrylonitrile-based fiber bundle were then measured. These results are shown in Tables 1 and 2.

Furthermore, the resin impregnating ability, tow spreading ability, covering ability, and strand strength of the carbon fiber bundle obtained by baking the aforementioned acrylonitrile-based fiber bundle were then evaluated. These results are shown in Table 3.

Example 8

An acrylonitrile-based fiber bundle with a monofilament size of 1.1 dtex was obtained in the same manner as in Example 1 with the exception that the concentration of the amino silicon-based oiling agent added to the fiber bundle was changed to 0.4 wt. %.

The cross-sectional shape, amount of Si, liquid content ratio, monofilament strength, water content, confounding degree, and wrinkle contour of the resultant acrylonitrile-based fiber bundle were then measured. These results are shown in Tables 1 and 2.

Furthermore, the resin impregnating ability, tow spreading ability, covering ability, and strand strength of the carbon fiber bundle obtained by baking the aforementioned acrylonitrile-based fiber bundle were then evaluated. These results are shown in Table 3.

Example 9

An acrylonitrile-based fiber bundle with a monofilament size of 1.1 dtex was obtained in the same manner as in Example 1 with the exception that the air pressure at the time of the confounding process was changed to 290 kPa.

The cross-sectional shape, amount of Si, liquid content ratio, monofilament strength, water content, confounding degree, and wrinkle contour of the resultant acrylonitrile-based fiber bundle were then measured. These results are shown in Tables 1 and 2.

Furthermore, the resin impregnating ability, tow spreading ability, covering ability, and strand strength of the carbon fiber bundle obtained by baking the aforementioned acrylonitrile-based fiber bundle were then evaluated. These results are shown in Table 3.

Comparative Example 1

An acrylonitrile-based fiber bundle with a monofilament size of 1.1 dtex and a monofilament fiber cross section length/width ratio of 1.02 was obtained in the same manner as in Example 1 with the exception that the dimethyl acetamide concentration of the first and second coagulation baths was changed to 70 wt. %.

The cross-sectional shape, amount of Si, liquid content ratio, monofilament strength, water content, confounding degree, and wrinkle contour of the resultant acrylonitrile-based fiber bundle were then measured. These results are shown in Tables 1 and 2.

Furthermore, the resin impregnating ability, tow spreading ability, covering ability, and strand strength of the carbon fiber bundle obtained by baking the aforementioned acrylonitrile-based fiber bundle were then evaluated. These results are shown in Table 3.

This carbon fiber bundle obtained from an acrylonitrile-based fiber bundle having a monofilament fiber cross section length/width ratio of less than 1.05 displayed both an inferior resin impregnating ability and tow spreading ability.

Comparative Example 2

An acrylonitrile-based fiber bundle with a monofilament size of 1.1 dtex was obtained in the same manner as in Example 1 with the exception that the dimethyl acetamide concentration of the first and second coagulation baths was changed to 40 wt. %.

The cross-sectional shape, amount of Si, liquid content ratio, monofilament strength, water content, confounding degree, and wrinkle contour of the resultant acrylonitrile-based fiber bundle were then measured. These results are shown in Tables 1 and 2.

Furthermore, the resin impregnating ability, tow spreading ability, covering ability, and strand strength of the carbon fiber bundle obtained by baking the aforementioned acrylonitrile-based fiber bundle were then evaluated. These results are shown in Table 3.

This acrylonitrile-based fiber bundle having a monofilament fiber cross section length/width ratio exceeding 1.6 displayed an inferior compactness, and the strand strength of the carbon fiber bundle obtained therefrom was significantly low.

TABLE 1

| | Cross sectional shape (length/width) | Amount of Si (ppm) | Liquid content ratio (wt. %) | Monofilament strength (cN/dtex) |
|---|---|---|---|---|
| Examples | | | | |
| 1 | 1.32 | 2500 | 52.25 | 7.2 |
| 2 | 1.51 | 2650 | 58.18 | 6.8 |
| 3 | 1.23 | 2600 | 46.56 | 7.7 |
| 4 | 1.32 | 2550 | 49.56 | 7.5 |
| 5 | 1.32 | 2500 | 44.72 | 6.1 |
| 6 | 1.32 | 2500 | 54.43 | 7.3 |
| 7 | 1.32 | 2500 | 48.77 | 7.2 |
| 8 | 1.32 | 1600 | 51.34 | 7.3 |
| 9 | 1.32 | 2500 | 53.80 | 7.2 |
| Comparative Examples | | | | |
| 1 | 1.02 | 2600 | 30.29 | 7.3 |
| 2 | 1.72 | 3400 | 64.85 | 4.8 |

TABLE 2

| | Water content (wt. %) | Confounding degree (per meter) | Wrinkle contour Ra (μm) | Ry (μm) | S (μm) |
|---|---|---|---|---|---|
| Examples | | | | | |
| 1 | 5 | 12 | 0.05 | 0.33 | 0.55 |
| 2 | 5 | 11 | 0.08 | 0.35 | 0.68 |
| 3 | 5 | 12 | 0.04 | 0.32 | 0.53 |
| 4 | 5 | 13 | 0.08 | 0.40 | 0.70 |
| 5 | 5 | 12 | 0.03 | 0.29 | 0.58 |
| 6 | 10 | 6 | 0.05 | 0.33 | 0.55 |
| 7 | 3 | 15 | 0.05 | 0.33 | 0.56 |
| 8 | 5 | 12 | 0.05 | 0.33 | 0.53 |
| 9 | 5 | 7 | 0.05 | 0.33 | 0.54 |
| Comparative Examples | | | | | |
| 1 | 5 | 3 | 0.02 | 0.05 | 0.18 |
| 2 | 5 | 15 | 0.12 | 0.65 | 0.80 |

TABLE 3

| | Carbon fiber bundle | | | | |
|---|---|---|---|---|---|
| | Resin impregnating ability (%) | Tow spreading ability (mm) | Covering ratio (%) | Strand strength (kg/mm$^2$) | Carbonizing processing ability |
| Examples | | | | | |
| 1 | 4.76 | 2.5 | 97.7 | 430 | No problem |
| 2 | 5.10 | 2.7 | 98.2 | 400 | No problem |
| 3 | 3.60 | 2.1 | 95.5 | 450 | No problem |
| 4 | 4.50 | 2.4 | 96.8 | 410 | No problem |
| 5 | 4.46 | 2.3 | 96.7 | 440 | No problem |
| 6 | 4.88 | 2.9 | 98.7 | 430 | No problem |
| 7 | 4.71 | 2.1 | 95.2 | 425 | No problem |
| 8 | 4.66 | 2.8 | 99.1 | 430 | No problem |
| 9 | 3.98 | 2.9 | 99.0 | 430 | No problem |
| Comparative Examples | | | | | |
| 1 | 1.32 | 1.4 | 87.5 | 430 | No problem |
| 2 | 7.22 | 3.2 | 99.8 | 350 | unfavorable |

What is claimed is:

1. A carbon fiber bundle, wherein the carbon fiber strand strength is at least 400 kg/mm$^2$, the resin impregnating ability is at least 3.6%, and the tow spreading ability per 12,000 of monofilaments is at least 2 mm.

2. The carbon fiber bundle according to claim 1, wherein the covering ratio is at least 95%.

3. The carbon fiber bundle according to claim 1, wherein the carbon fiber strand strength is at least 450 kg/mm$^2$.

4. The carbon fiber bundle according to claim 1, wherein the carbon fiber strand strength is at least 440 kg/mm$^2$.

5. The carbon fiber bundle according to claim 1, wherein the carbon fiber strand strength is at least 430 kg/mm$^2$.

6. The carbon fiber bundle according to claim 1, wherein the carbon fiber strand strength is at least 400 kg/mm$^2$.

7. The carbon fiber bundle according to claim 1, wherein the resin impregnating ability is at least 4.8%.

8. The carbon fiber bundle according to claim 1, wherein the resin impregnating ability is at least 3.9%.

9. The carbon fiber bundle according to claim 1, wherein the resin impregnating ability is at least 3.6%.

10. The carbon fiber bundle according to claim 1, wherein the tow spreading ability per 12,000 of monofilaments is at least 2.9 mm.

11. The carbon fiber bundle according to claim 1, wherein the tow spreading ability per 12,000 of monofilaments is at least 2.5 mm.

12. The carbon fiber bundle according to claim 1, wherein the tow spreading ability per 12,000 of monofilaments is at least 2.1 mm.

13. The carbon fiber bundle according to claim 1, wherein the covering ratio is at least 99%.

14. The carbon fiber bundle according to claim 1, wherein the covering ratio is at least 98%.

15. The carbon fiber bundle according to claim 1, wherein the covering ratio is at least 97%.

16. The carbon fiber bundle according to claim 1, wherein the covering ratio is at least 96%.

17. A composite fiber reinforced composite material, comprising the carbon fiber bundle of claim 1.

18. A plain weave cloth, comprising the carbon fiber bundle of claim 1.

* * * * *